United States Patent [19]

Mershon

[11] Patent Number: 4,741,233

[45] Date of Patent: May 3, 1988

[54] CLUSTER SPREADING AND CUTTING SYSTEM

[76] Inventor: Verl M. Mershon, 6487 Heritage Hills Dr., Glen Burnie, Md. 21061

[21] Appl. No.: 920,939

[22] Filed: Oct. 20, 1986

Related U.S. Application Data

[63] Continuation of Ser. No. 775,694, Sep. 12, 1985, abandoned, which is a continuation of Ser. No. 599,121, Apr. 11, 1984, abandoned.

[51] Int. Cl.[4] ..... B65H 29/46

[52] U.S. Cl. ..... 83/91; 83/155; 83/171; 83/367; 83/370; 83/517; 83/631; 83/649; 83/651.1; 83/925 CC; 270/30

[58] Field of Search ..... 83/925 CC, 171, 91, 83/87, 651.1, 155, 516, 517, 370, 367, 631, 649; 270/30

[56] References Cited

U.S. PATENT DOCUMENTS

| | | | |
|---|---|---|---|
| 412,802 | 10/1889 | Simoulin . | |
| 562,989 | 6/1896 | Waite . | |
| 573,448 | 12/1896 | Cox . | |
| 1,082,692 | 12/1913 | Gustin . | |
| 1,224,550 | 5/1917 | Johnston . | |
| 1,449,445 | 3/1923 | Rand . | |
| 1,571,808 | 2/1926 | Schwartzman . | |
| 2,570,877 | 10/1951 | Spinelli . | |
| 3,083,008 | 3/1963 | Miller | 270/30 X |
| 3,117,211 | 1/1964 | Tansey . | |
| 3,456,580 | 7/1969 | Preston . | |
| 3,465,671 | 9/1969 | McPherson . | |
| 3,548,697 | 12/1970 | Gerber et al. . | |
| 3,587,372 | 6/1971 | Prew . | |
| 3,587,377 | 6/1971 | Olson et al. | 83/171 |
| 3,667,332 | 6/1972 | Kirche . | |
| 3,672,249 | 6/1972 | Sasaki . | |
| 3,688,622 | 9/1972 | Wahnschaff . | |
| 3,768,800 | 10/1973 | Gutknecht . | |
| 3,790,156 | 2/1974 | Hogendyk | 270/30 |
| 3,826,170 | 7/1974 | Jones et al. . | |
| 3,877,628 | 4/1975 | Asselin et al. . | |
| 3,913,904 | 10/1975 | Occhetti | 270/30 |
| 3,921,480 | 11/1975 | Ball | 83/171 X |
| 4,034,634 | 7/1977 | Arbter . | |
| 4,088,049 | 5/1978 | Benedict . | |
| 4,155,543 | 5/1979 | Costigan . | |
| 4,167,434 | 9/1979 | Morgan . | |
| 4,179,108 | 12/1979 | Grimm et al. . | |
| 4,419,913 | 12/1983 | Schütt et al. . | |

FOREIGN PATENT DOCUMENTS

| | | | |
|---|---|---|---|
| 1455851 | 11/1976 | United Kingdom | 83/171 |

*Primary Examiner*—Frank T. Yost

*Attorney, Agent, or Firm*—Sughrue, Mion, Zinn, Macpeak and Seas

[57] ABSTRACT

A system for spreading and severing material utilizing a roller movable over a lower substrate and carrying with it a loop of material for spreading without tension. One or two plies are spread as a function of roller travel prior to severing from a source. If two plies are spread, severing of the loop occurs at the roller by an element movable with the roller. A second severing element is located at one end of the substrate to separate material from the source. A top platen carries a removable substrate having thereon multiple patterns. The patterns are defined by a resistance wire having thermal expansion joints and carried by stand-off insulators mounted on the removable substrate. When the wires are brought into contact with the material on the lower substrate, severing occurs. Multiple cycles of spreading and severing may occur prior to removal of the lower substrate.

19 Claims, 6 Drawing Sheets

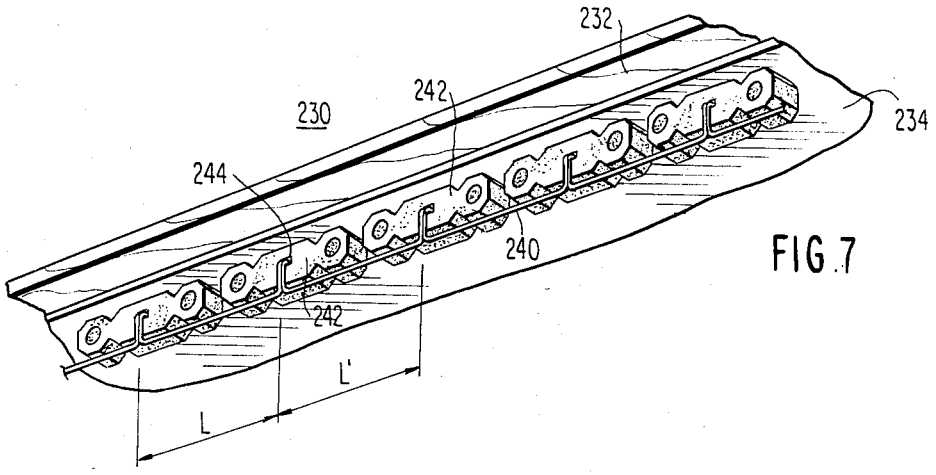
FIG.7
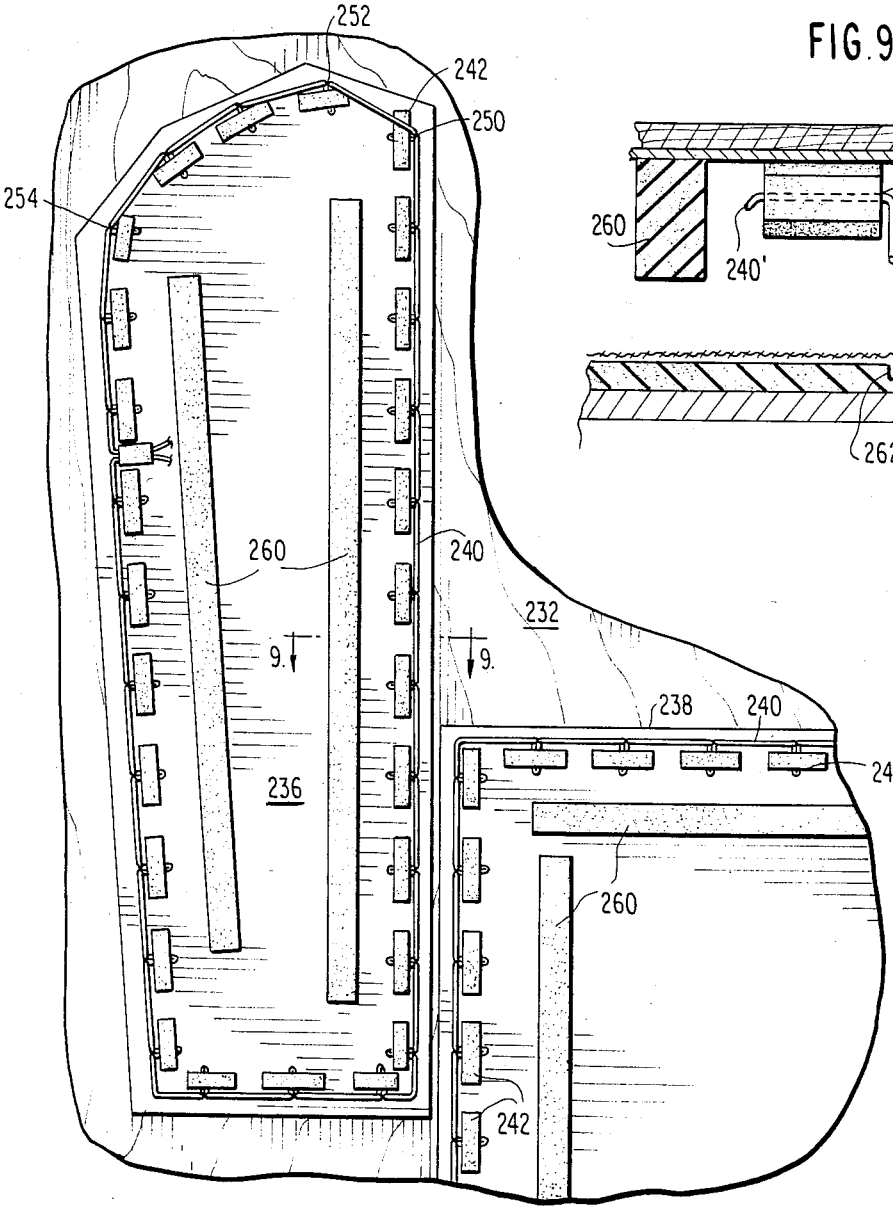
FIG.8
FIG.9
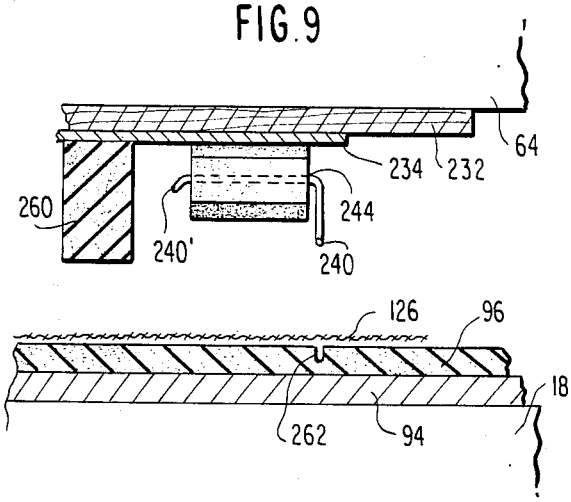

CLUSTER SPREADING AND CUTTING SYSTEM

This is a continuation of Ser. No. 775,694, filed on Sept. 12, 1985 which is a continuation of Ser. No. 599,121 filed on Apr. 11, 1984, both abandoned.

BACKGROUND OF THE INVENTION

This invention relates to the cutting of flexible materials such as fabrics, foam, plastic rubber sheets and the like. In particular, the invention relates to an improved system for spreading material to be cut and then a simultaneous severing of material into multiple patterns having predetermined sizes and shapes.

Cutting systems are typically used to produce from roll goods or sheets pattern pieces which are subsequently assembled into a finished unit. In, for example, the manufacturer of clothing, the same patterns are cut over and over. The pieces are removed from the cutting room and stitched into a completed garment. Throughput has been hampered by the lack of speed in cutting. Moreover, a significant portion of the cost of a finished item is the cost associated with cutting the components. Thus, a standing requirement in the garment and other industries associated with cutting and assembling multiple patterns is to decrease increased costs and yet increase efficiency in the cutting operation.

A variety of techniques have been employed to render more efficient the cutting operation. Generally, speed and efficiency are a function of the spreading of the material onto a cutting surface and the time required to cut patterns from a marker. Prior cutting operations have used power presses and dies in, for example, the cutting of garment patterns wherein standard sizes are replicated many fold. Such die press operations are advantageous in terms of speed but, suffer disadvantages in terms of cost of equipment, rejection rates and system maintenance. Additionally, die systems utilizing presses are not efficient relative to material utilization. The component pieces which form the pattern marker must be spaced at sufficient distances to allow for compensation in ply bending or so-called "valleys" which tend to form as a consequence of the downward force of the cutting die.

Distinct from the die cutting process is the use of knives. These knives may either be sharp thin knives, laser cutters, water-jet cutters and the like. Knife cutting is generally done by remote control having the cutting instrument mounted on a X-Y carriage. The cutting instrument then traces the marker for sequential cutting of the patterns. While such cutting techniques produce quality pieces with low kerf, the rate of cutting is relatively slow vis-a-vis the entire pattern.

By comparison to die techniques wherein simultaneous cutting occurs, cutting rates are deemed to be unacceptably slow. Also, in the case of some cutting devices using heat, multiple layers heretofore could not be cut in the case of synthetic fabrics. The heat associated with cutting bonded the layers together. Thus, only one layer at a time could be cut.

A second deficiency in conventional system is in the spreading of raw material to be cut and in the removal of cut goods from the cutting table. Spreading generally occurs by unrolling from a source under tension one layer of fabric at at time. The fabric is held down on the cutting table either by clamps or vacuum hold-down techniques. The material in either case is therefore stretched such that a degree of distortion exists between the desired pattern size and the pattern cut in the stretched material. In the case of spreading multiple layers, contact between the layer to be spread and the layer already positioned on the cutting table results in interlayer shear tending to crease or wrinkle the layer on the cutting table. Consequently, techiques of spreading material for cutting tend to be slow, labor intensive, and subject the material to distortion if held under tension.

When the material is cut, it is generally removed from the cutting table by means of conveyors or the like where the cut pieces are removed and then reoriented for subsequent stitching. Between the process of removal of the cut pieces intermingling of components results, individual components are sometimes folded and creased and the operation of severing subsequent layers is delayed until all cut pieces have been removed from the cutting table.

SUMMARY OF THE INVENTION

Given these deficiencies in conventional systems, it is an object of this invention to provide an improved spreading and severing system. This invention first spreads all types of flat goods, that is, paper, plastics, foams, sheet rubber and fabrics without tension. Secondly, it simultaneously severs the material into a number of patterns accurately and without distortion. Removal of the severed and parted patterns occur simultaneously utilizing a unique material handling technique.

An important aspect of this invention is the use of a multi-layer laminant defined as a "choerd." As used herein, a "choerd" has two major subcomponents and the first is the severing module and the second the spreading module. Both incorporate a rigid substrate, such as ply wood, fiberboard or the like as a rigid backing. The spreading module of the "choerd" has a flexible layer such as sponge rubber over the substrate. Raw material is spread over the flexible material in either a single or multiple layers to be severed.

In the context of this invention the action of defining a pattern in the blank is by severing it rather than cutting. Cutting implies that no loss of material results. Here, due to the application of heat, a minute loss of material occurs in the kerf. Hence, "severing" is deemed to more accurately define the action taking place. The severing module of the "choerd" comprises a second flat hard material having electrical severing elements fixed thereto in a pattern replicating a conventional severing room marker but uniquely configured. The severing element is typically a nichrom wire of approximately 0.030 inches. The wire is bent in a configuration to effectuate accurate severing with narrow kerf by the use of expansion joints to compensate for thermal expansion during heating. To effectuate severing, the severing module of the choerd is lowered onto the spread fabric. One or more layers may be cut without pressure. The severing module is then raised, additional layers spread onto the spreading module of the choerd and the operation again takes place. When a desired number of layers have been cut, the spreading module of the choerd is removed from the machine intact with all severed portions aligned in the predetermined marker.

Another important aspect of this invention is the techique of spreading raw material onto the spreading module of the choerd without tension. Spreading occurs by the use of a spreading roller engaging roll goods which are clamped at a free end freely releasable from a source. The spreader, as it traverses the cutting table, then forms a loop of raw material. Depending on whether single or multiple layers are to be spread, cutting of the loop portion occurs and the spreading roller has traversed either approximately half way across the cutting table or nearly all the way across. The material to be spread is not subjected to interlayer shear since it does not contact previously spread and cut layers under tension and no tension holddown techniques are required. The spreading roller is timed in conjunction with a system controller such that its movement is in sequence with the up and down movement of the upper portion of the choerd. Consequently, spreading and cutting are alternative, repetitive cycles in the system.

Given the fact that spreading occurs automatically, and simultaneous severing of multiple patterns is achieved, system throughput is materially enhanced. This invention will be described in greater detail by referring to the attached drawings and a description of the preferred embodiment which follows.

BRIEF DESCRIPTION OF THE DRAWINGS

FIG. 7 is a partial perspective view of a portion of the upper choerd illustrating placement of severing wires and stand-off insulators;

FIG. 8 is a plan view showing a portion of the upper choerd having an arrangement of patterns to be severed;

FIG. 9 is a schematic view along line 9—9 of FIG. 8 illustrating the relationship between the top and bottom choerds and the material to be served;

FIGS. 14B, 15B and 16B are partial elevation views of the system illustrating spreading and severing multiple plies.

DESCRIPTION OF THE PREFERRED EMBODIMENT

Figure 2:
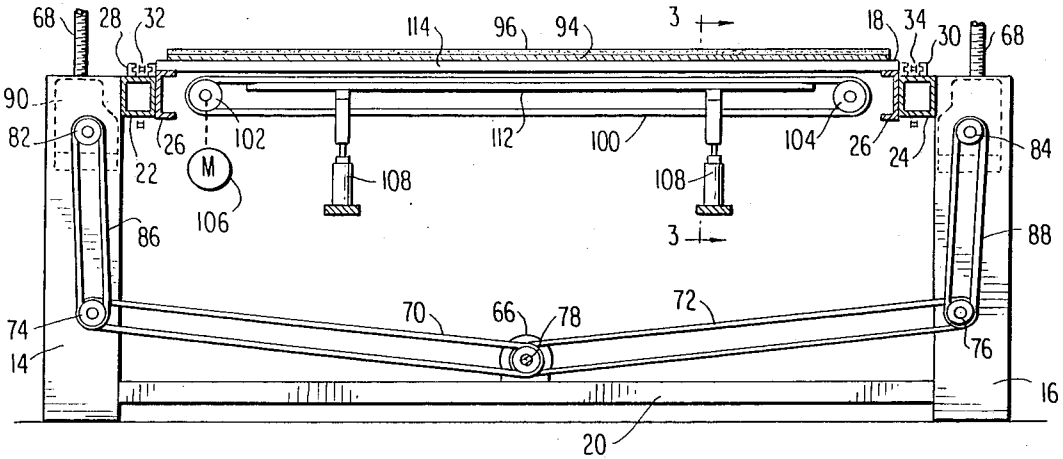
FIG. 2 is an elevation end view of the system shown in FIG. 1.
Figure 1:
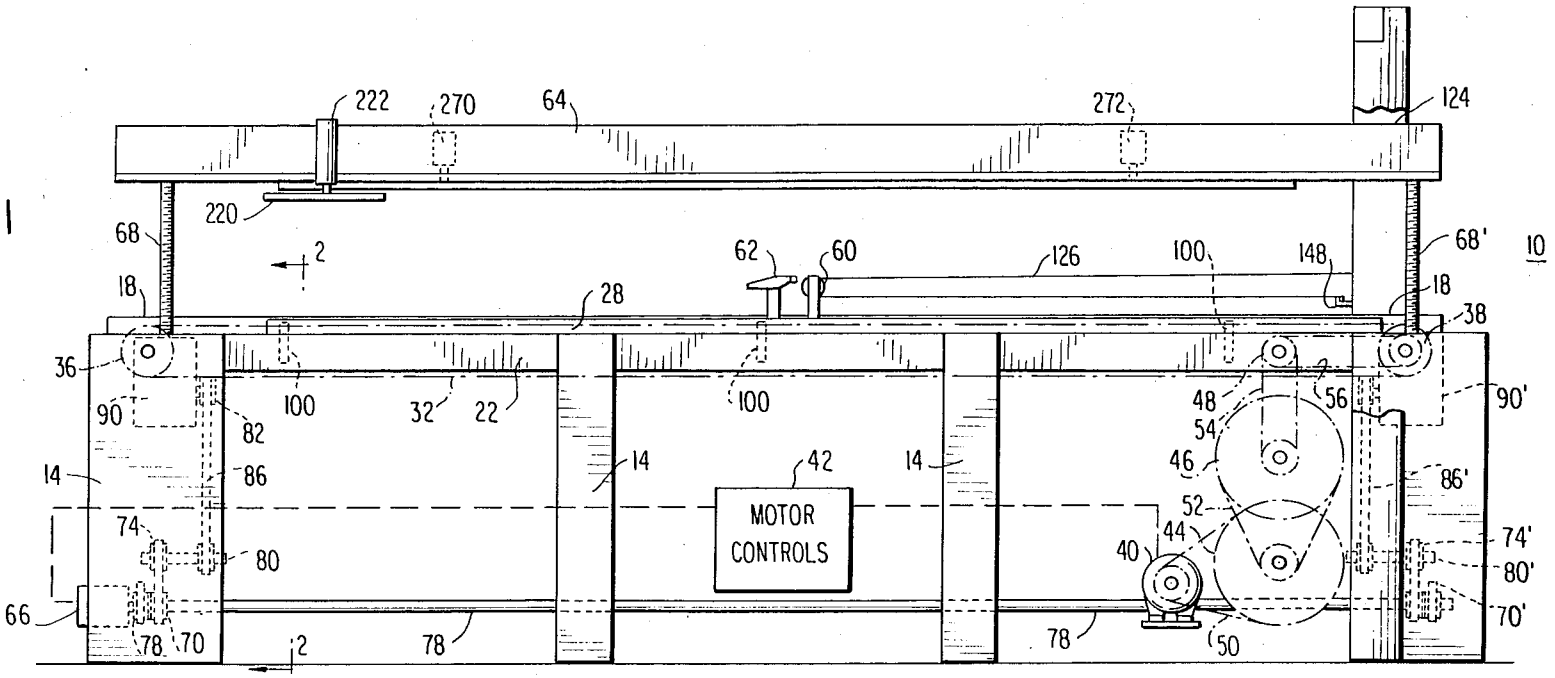
FIG. 1 is an elevation side view of the severing system in accordance with the present invention.

Referring first to FIGS. 1 and 2, the basic operating components of this invention will be described. The severing system 10 comprises a stationary table 12 having a vertical frame 14 and 16 supporting a stationary and rigid lower platen surface 18. Cross members 20 as required are disposed to provide the necessary rigidity for the table structure. Mounted at two sides of the table are structural beams 22 and 24 together with angle braces 26 and 28 affirmatively coupling platen surface 18 to frame members 14 and 16. Frames 22 and 24 also support guide channel 28 and 30 having placed therein chain elements 32 and 34. The chains 32 and 34 have a run continuously longitudinally of the lower platen surface 18 that "down" the working area. Sprockets 36 and 38 are placed at opposite ends of the table so that the chains have a continuous loop. While not shown in FIG. 1, it is understood that a duplicate set of sprockets is disposed on the other side of the table. The chains are driven synchronously by means of motor 40 which is suitably mounted on the system, for example on brace member 20. The motor 40 may be a suitable DC motor, a stepper motor or the like suitably controlled by a motor controller 42 so that the rate of advancement of the chains 32 and 34 may be accurately controlled. A shaft encoder measures rotation of the motor shaft. By means of drive pulleys 44, 46 and 48, coupled to each other respectivley by belts 50, 52, 54 and 56, rotational movement of the motor 40 is transmitted to the drive sprocket 38 such that the chains are driven in a synchronous and controlled manner. Drive sprocket 38 is suitably journaled on shaft 58 (see, FIG. 4). While it is understood that the drive sprocket 38 has a series of teeth engaging the chain, other drive techniques can also be employed such as guy wires and the like.

Mounted for movement on the chain is a spreader roller 60 and a severing mechanism 62 to be described herein in detail. Both spreader roller 60 and severing mechanisms 62 are mounted on respective parallel links of the chains 32 and 34 such that they traverse the cutting table in a direction from right to left as shown in FIG. 1, then looping around sprocket 36 and returning to a start position on the right hand side of the table by traversing under the table on the lower run of the chains.

Referring back to FIG. 1, the system comprises a top platen 64 which is movable vertically relative to the lower platen 18. The top platen 64 carries an upper choerd (see, FIG. 8) carrying the severing elements for performing the severing operation. A jack drive system is used to raise and lower the top platen 64. A jack drive motor 66 is mounted in the system, for example, on frame 20 and utilizes a series of drive belts which actuate a lifting jack screw mechanism. Four jack screws 68 are positioned at ends of the top platen 64. At one end of the system, shown in FIG. 2, motor 66 drives belts 70, 72 onto transfer rollers 74, 76 via pulley 78. Pulleys 74 and 76 mounted for rotation on frame members 14 and 16 via shafts 80 are then coupled to drive pulley 82, 84 via belt 86, 88. A transfer mechanism 90 converts the rotary motion of pulleys 82 and 84 into vertical movement of the jack screw 68 by advancement of the threaded section 92. Thus, as shown in FIG. 2, one end of the platen 64 is moved vertically in synchronism as a function of the output of the motor 66.

Referring to FIG. 1, it will be appreciated that output shaft 78 extends the length of the title 18 and through a second identical set of pulleys and belts, indicated by prime numbers, e.g. 70', 80', etc., movement of a second set of jack screws 68' at the righthand end of the system occurs. Thus, as will be discussed relative to FIG. 16, vertical movement of the top platen 64 is used to move the severing elements into position to effectuate severing of material placed on the lower platen 18.

Figure 3:
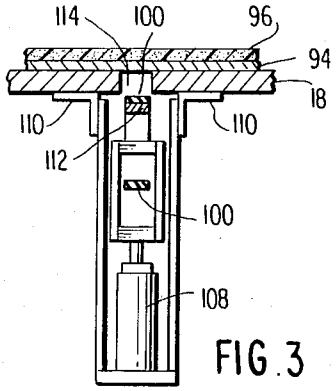
FIG. 3 is a sectional view along line 3—3 in FIG. 2, illustrating the details of the choerd lifting mechanism.

In accordance with the present invention, material which is to be spread and subsequently severed is initially placed on a lower choerd comprising, as shown in FIG. 2 a rigid substrate 94, for example, plywood, alluminum or the like, having thereon a flexible backing such as foamrubber or the like 96. The composite lower choerd 94–96 is positioned on the lower platen 18 and removable therefrom by means of a transverse drive system shown in FIGS. 2 and 3. Specifically, a transverse belt 100 mounted on pulleys 102, 104 is driven by motor 106 coupled to either pulley, for example pulley 102. Thus, driving of the belt 100 occurs in a direction perpendicular to movement of the chains 32 and 34, that is across the table. The upper run of the drive pulley 100 is positioned below the platen 18 which is shown in FIG. 3 and has a series of grooves 114 therein. At selective locations cylinders 108 are coupled to the lower portion of platen 18 by means of braces 110. The cylinder carries an actuating piston 112 which engages the upper run of the pulley 100 urging it into the slot 114 formed in the platen 18. By this action, as the pulley 100 moves, it is urged by means of the piston 112 into engagement with the rigid plywood substrate 94 of the lower choerd thereby moving the lower choerd in a traverse direction across the table. The choerd is therefore moved either onto the table and positioned registration for subsequent actuation of the system or moved laterally off the table when severed pieces are to be removed from the system.

Referring now to FIGS. 4, 10, 11, 12 and 13, the technique of obtaining initial registration and spreading of material to be severed will be described. Disposed at one end of the system is a source of material to be severed, for example, a roll 120 mounted for free rotation on shaft 122 carried by frame members 124 at either side of the system. It will be appreciated that if material to be severed is not input in roll form, for example, sheets of foam, plastic or the like, such may be placed on the lower choerd 94–96 and input to the system directly as flat goods. However, assuming that the material is input from a roll 120, the material 126 engages pinch rollers 128 and 130 forming a nipping region therebetween. Pinch roller 130 is driven by motor under system control, shown schematically via switch 134. Roller 130 pivots at point 136 and is driven by cylinder-piston actuator 138 for selective engagement with roller 128. It will be appreciated that when cylinder 138 is actuated roller 130 and its associated support, rotates on pivot 136 to engage pinch roller 128. By actuation of the motor 132, rotation occurs in a manner shown by the arrow in FIG. 11 so that material 126 is drawn from the roll 120 which is free wheeling and drops into the chute defined by guideplates 140 and 142. A sensor 144 is employed to monitor the passage of the leading edge of the material in a downward direction shown by arrow 146 such that at a predetermined time, motor 132 ceases operation with the leading edge of the fabric in registration with a guide plate clamp 148 (see, FIG. 11).

Figures 4, 5, 6:
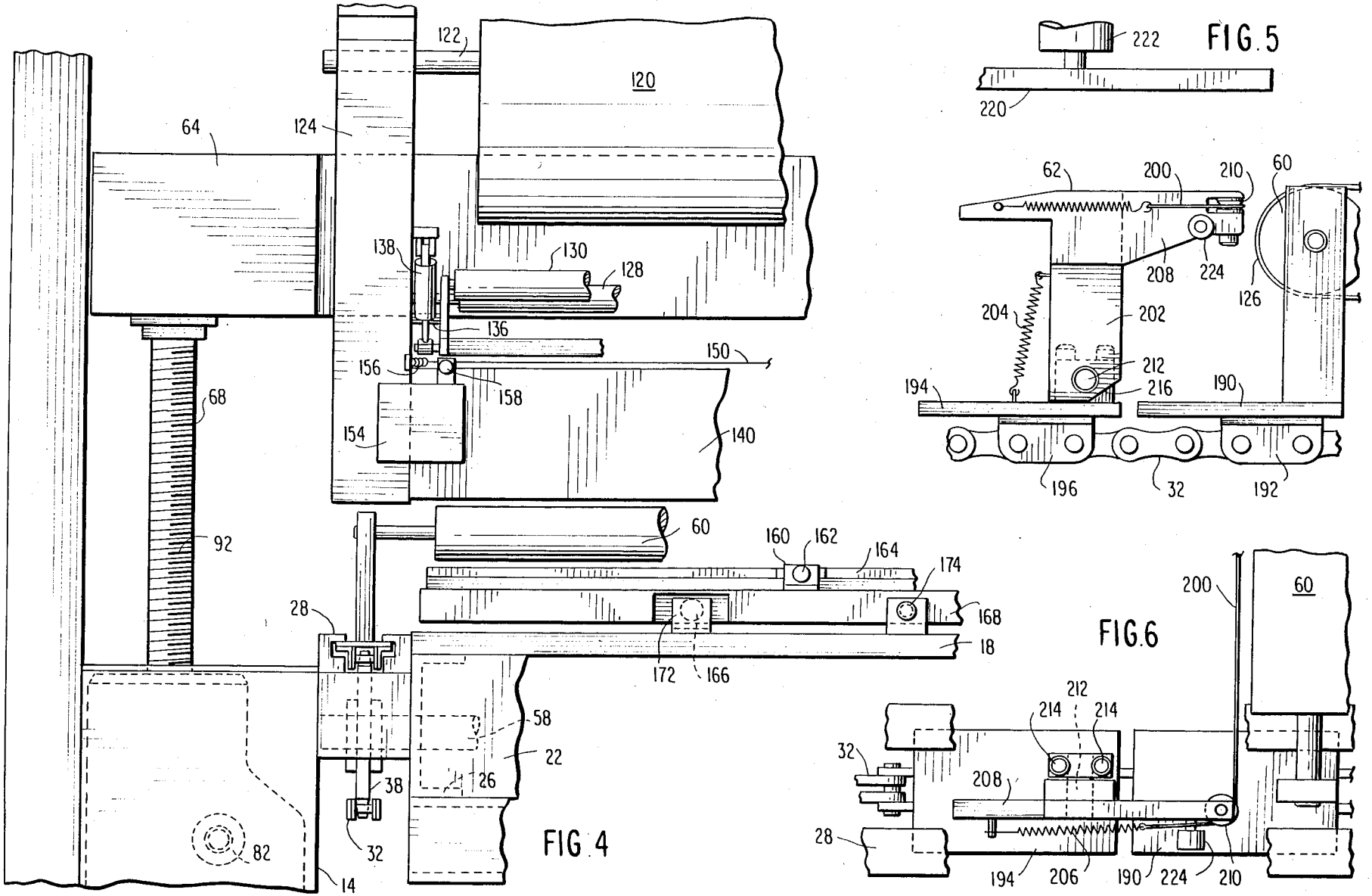
FIG. 4 is a fragmentary end view of the system shown in FIG. 1 illustrating the details of spreader roller actuation, top platen movement and sheet clamping.
FIG. 5 is a partial elevation view illustrating the details of the mechanism for use in multiple sheet spreading and severing.
FIG. 6 is a plan view of the severing wire and carriage shown in FIG. 5.
Figure 12:
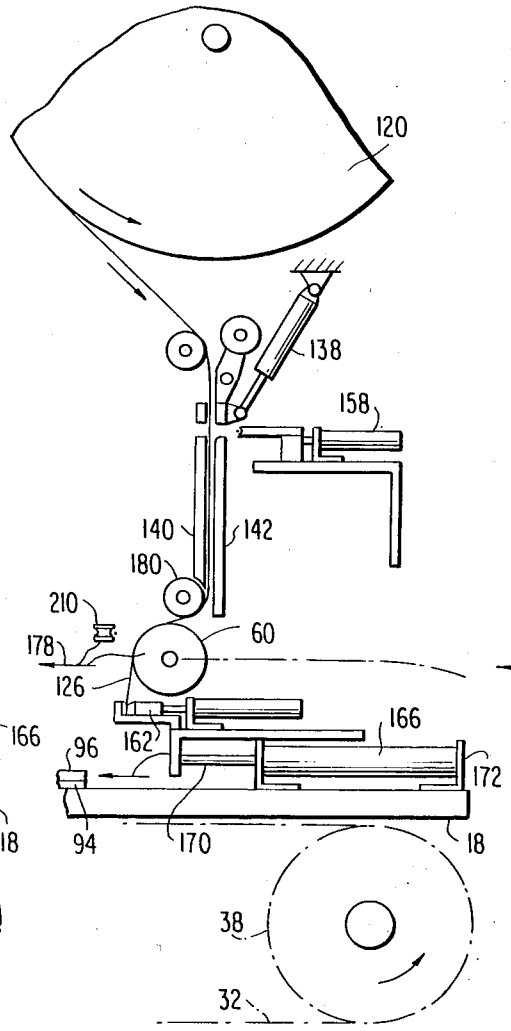
Figure 11:
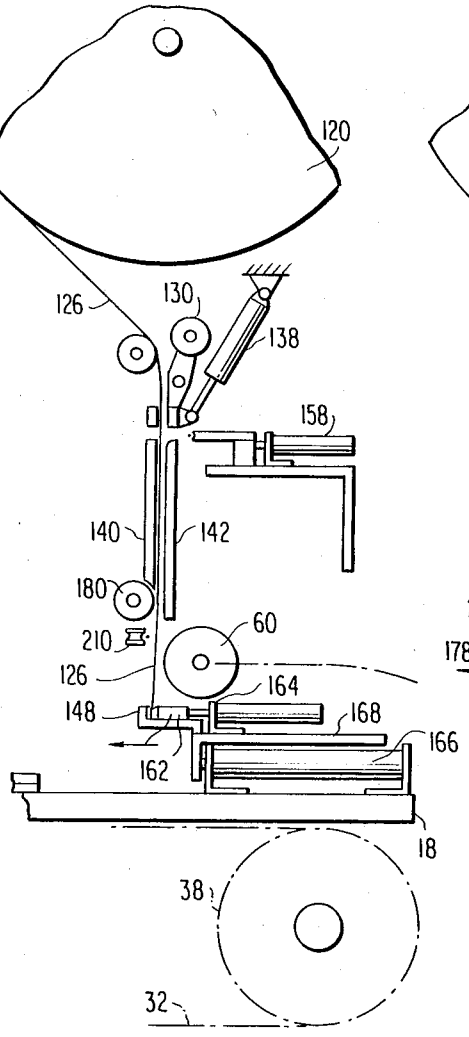
Figure 10:
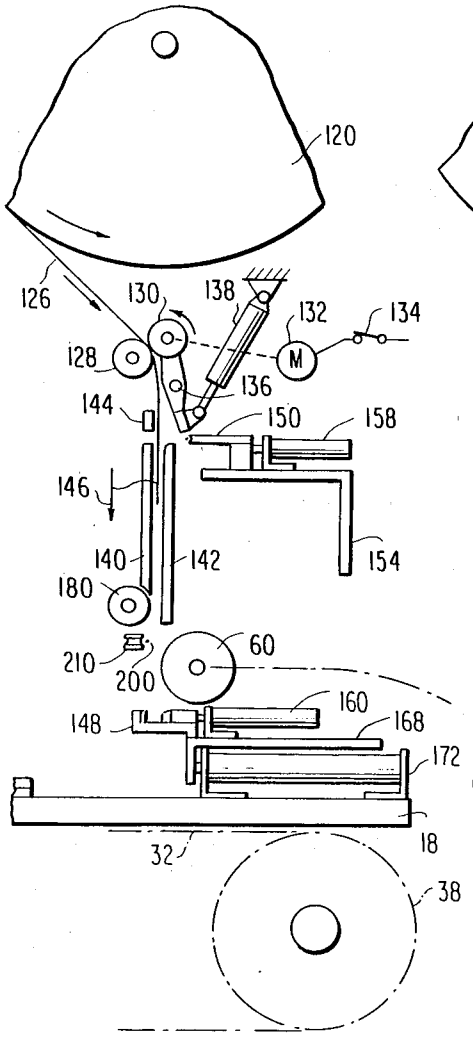

An electric wire severing element 150 extends widthwise across the table and therefore across the width of the material 126. The wire is mounted on a frame 154 and is spring loaded via spring 156 coupled to frame 124. The wire is displaceable in the direction of the material 126 by means of cylinder 158 such that at a predetermined time, to be discussed herein relative to FIG. 15, material is severed from the roll 120 with the free end still in engagement in the nip region formed between rollers 128 and 130. As shown in FIGS. 10 and 11, material 126 passes through guides 140 and 142 until it is in registration with the clamp element 148. Utilizing the output from sensor 144, the motor 132 is then stopped. An air cylinder 160 having a piston element 162 then, as shown in FIG. 11, advances in the direction of the arrow to clamp the fabric 126 against plate 148. As shown in FIG. 4, air cylinder 160 is carried by means of brace 164 in a "piggyback" fashion on top of a second air cylinder 166. Specifically, brace 164 is mounted on a second brace 168 operatively coupled to the piston element 170 of the second air cylinder 166. Cylinder 166 is then in turn fixedly mounted by means of braces 172 onto the lower platen 18. Consequently, as shown in FIG. 12, with material 126 clamped between piston 162 and brace 148, the entire assembly is then moved into the working area of the substrate 18 by a movement of the second cylinder 166. Thus, the leading edge of the fabric 126 is placed as shown in FIG. 12 adjacent to one edge of the chored 94–96. As shown in FIG. 4, plate 168 is carried by means of rod 174 to maintain a horizontal alignment of the assembly during movement.

As shown in FIGS. 10 through 13, the spreader roller 16 is disposed upstream of the material 126 with the cutting element 62 movable with the spreader roller disposed downstream of the material 126. FIG. 12 illustrates the third step in this clamping and registration procedure where the clamped material having been placed in registration with the lower choerd 94–96 is contacted by means of the spreader roller 60. That is, the spreader roller advances to engage the clamped material and form a loop around it.

Figure 13:
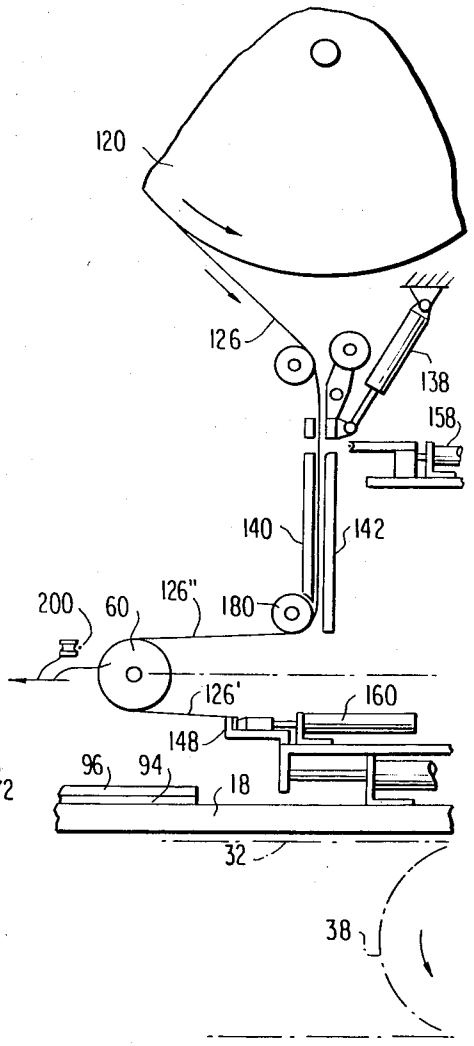
FIGS. 10, 11, 12 and 13 are fragmentary end views of the structure shown in FIG. 4 illustrating registration and movement of the spreading roll to move material onto the work area.

As shown in FIG. 13, continued movement of the spreader roller 60 results in material 126 being removed from the roll 120 such that the loop comprising a lower run 126' having a clamped end and then upper run 126'' is formed about the spreader roll 60 and enlarged. This step is common to spreading either one or two layers.

Figure 14A:
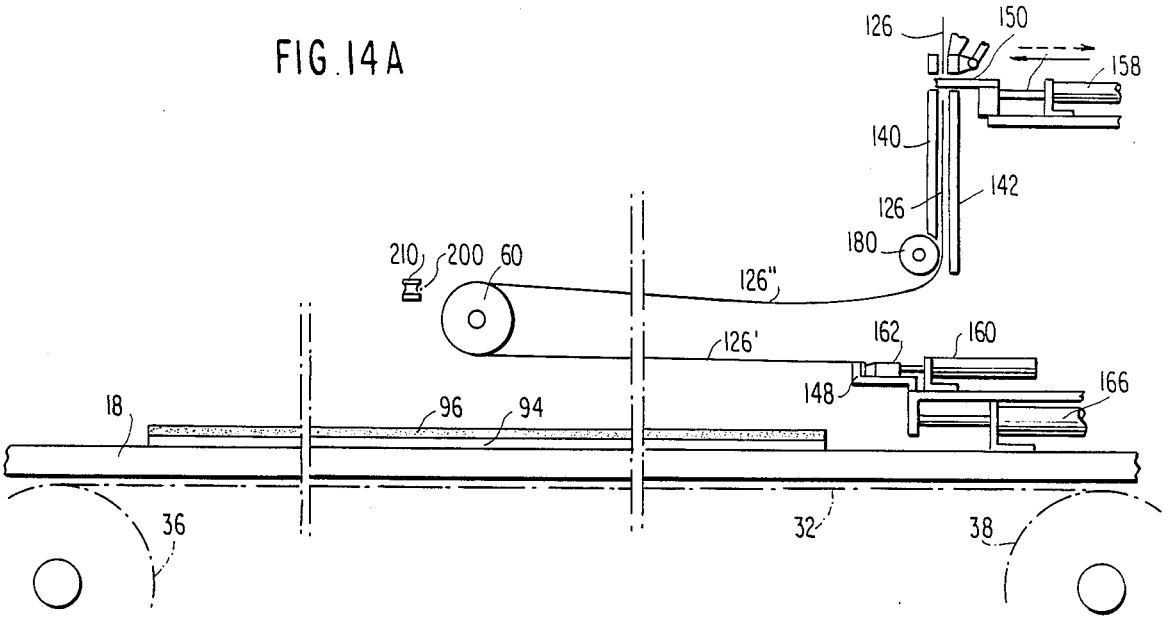
FIGS. 14B, 15B and 16B are schematic elevation views showing a system operation for spreading and severing a single ply.
Figure 15A:
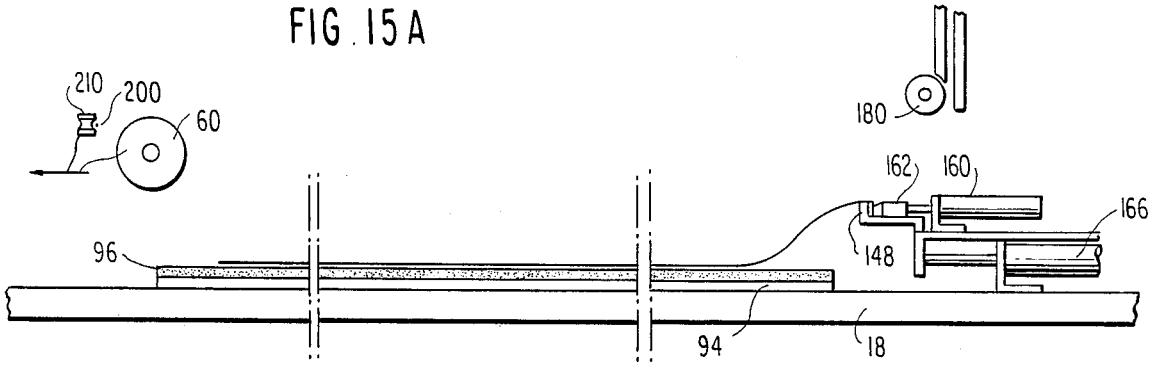
Figure 16A:
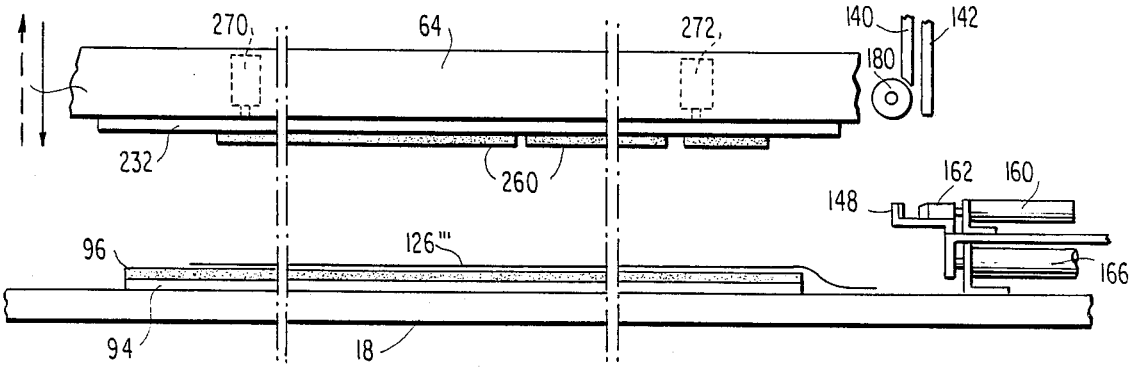
Figure 15B:
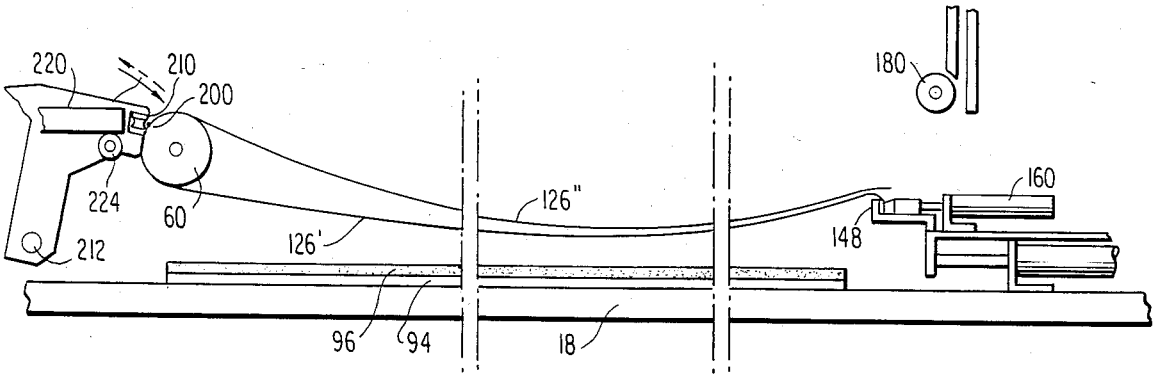

Referring now to FIGS. 14A, 15B and 16A, the technique of spreading and severing a single layer of fabric will be described. As the spreader roller 60 traverses across the platen 18 having positioned thereon the composite choerd 94–96 (it being understood that the roller is driven by chains 32, 34) the loop 126' and 126'' continues to grow and extend across the choerd. A guide roller 180 is used to provide a turning point from the guide portions 140 and 142. As shown in FIG. 14A, when the spreader roller 60 has traversed approximately one half of the width of the choerd, allowing for a quantity of material across one half the diameter of the roller 60, the air cylinder 158 is actuated such that the spring loaded severing wire 150 is in contact with the material 126. Thus, as shown in FIG. 14A, severing of the material occurs from the source 120.

FIG. 15A illustrates the spreader roller 60 continuing its travel and the now free end of the loop, that is the upper run 126'', moves over the roller 60 and is spread onto the foam rubber 96 of the choerd. The remaining end remains clamped via clamp mechanism 148 and 162. This clamp is then released, shown in FIG. 16A, and the secondary cylinder 166 then moves to the right so that the material falls freely and laps over one end of the choerd foam rubber 96. The single ply layer 126''' is then ready for severing by means of lowering of the top platen 64 carrying thereon the severing elements to be described herein for contact with the material.

Figure 14B:
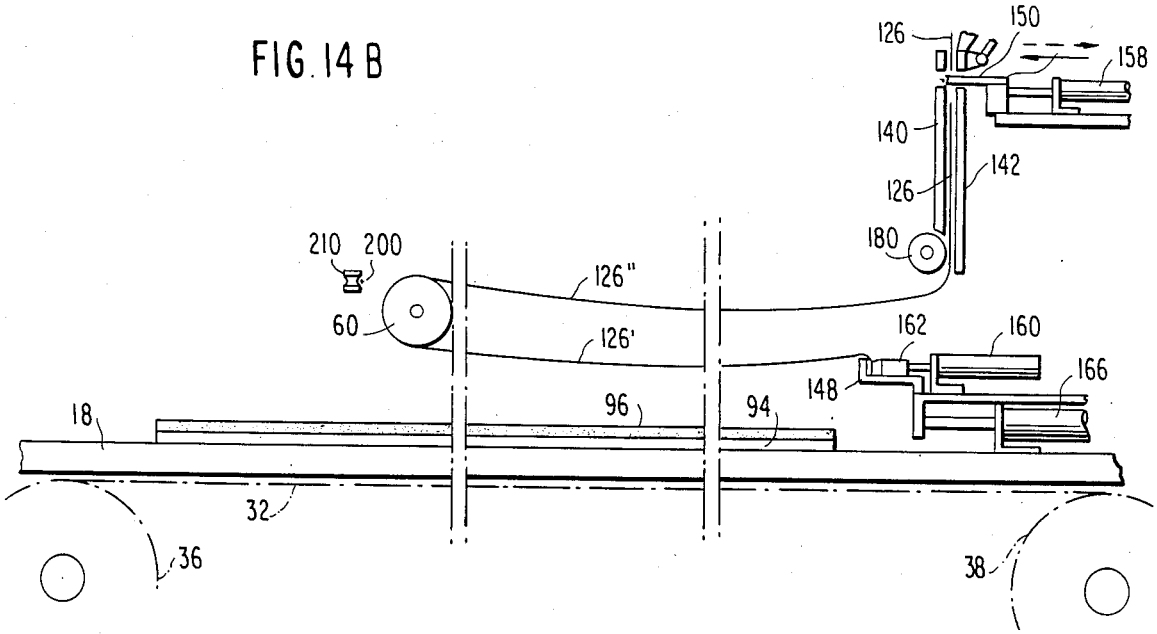
Figure 16B:
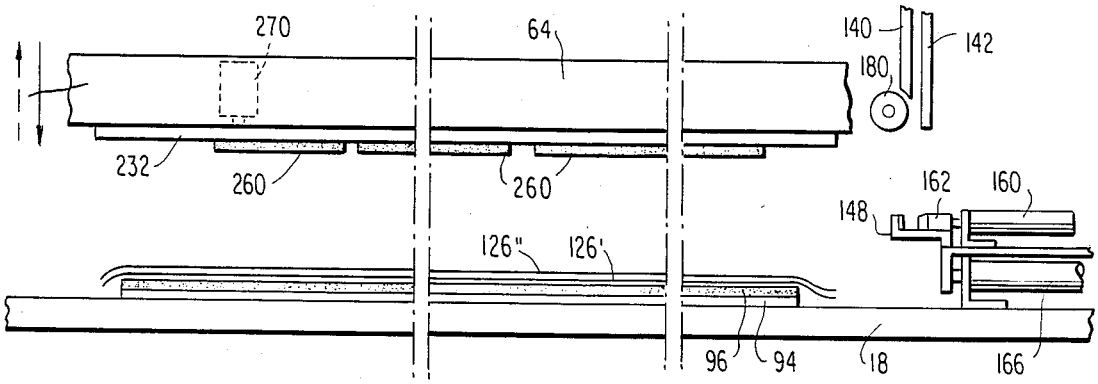

This invention is also operative to spread multiple layers without tension. Such is illustrated in FIGS. 14B, 15B and 16B. All of the elements of these figures are identical to those shown in FIG. 14A, 15A and 16A. However, an additional step is interposed and the sequencing is different. As shown in FIG. 14B, the spreader roller 60 continues its traversal across the choerd 94–96 with the lower run 126″ clamped in a manner identical for single ply spreading. When the spreader roller has traversed the choerd over a predetermined distance, severing of the material 126 occurs utilizing the wire severing element 150 in a manner identical to that described relative to FIG. 14A. However, a longer run of material is now involved since the spreader roller 60 has traversed a greater distance over the choerd.

As shown in FIG. 15B, when the spreader roller 60 has traversed the entire length of the choerd, material 126 forms a long loop having its runs 126′ and 126″ each extending over the entire length of the choerd. The second severing element 62 is then actuated with the runs 126′ and 126″ are severed from each other by point contact on the spreader roller 60. The spreader roller 60 and severing element 62 then continue to move such that multiple ply layers 126″ and 126′ each rest without tension over the choerd foam rubber backing 96. As shown in FIG. 16B, in a manner consistent with that of FIG. 16A, the air cylinders 160 and 166 are selectively actuated to unclamp the material and move the clamping assembly outside the severing area.

The technique of actuation of the severing element 62 will now be described relative to FIGS. 5 and 6. The spreader roll 60 is mounted on a carriage 190 coupled to a specific link via link coupler 192 so that the spreader roller advances in registration with movement of the chain 32. Moving in registration with the spreader roll 60, the severing element 62 is similarly mounted on a carriage 94 via link coupler 196.

The severing element 62 comprising a resistance wire 200 is mounted on a movable upright support 202 suitably spring biased via spring 204 to the support 194. The element 200 is itself tensioned via tension spring 206 coupling the wire 200 to a horizontally extending section 208 of the frame 206. Fairleads 210 are positioned to allow adequate tensioning of the element 200, typically a nichrome wire. Current is supplied to the nichrome wire by applying current directly to the chains 32, it being understood that elements 202, 208 are all metallic and therefore conductive. Support 202 is mounted for pivoting action about shaft 212 which itself is fixedly positioned on a carriage 194 by suitable means such as bolts 214. As shown in FIG. 5, support 202 has a chamfer portion 216.

The top platen 64 carries an actuating bar 220 movable downward via cylinder and piston 222. Support 208 carries with it a cam surface 224. When the platen 64 is positioned over the choerd 94, the actuating bar 220 is outside the severing area. By actuation of the cylinder 222, bar 220 lowers and contacts cam 224. This causes supports 202 and 208 to rotate clockwise until the chamfer portion 216 contacts support 194. The wire 200 also moves in a clockwise arcuate direction until contacts material 126 disposed around spreader roller 60. Severing of the material held in place by the spreader roller 60 therefore occurs when the wire 200 comes in contact with the material. Bar 220 is then retracted and the element 62 then rotates in a counterclockwise direction disengaging it from the spreader roller 60. By this technique, severing of the material to effectuate spreading of two plies as shown in FIG. 16B occurs.

With the material to be severed now spread on the lower choerd, without tension, that is either a single ply or two plies, the severing operation may proceed. This will be described herein relative to FIGS. 7, 8, 9 and 16. Details of the upper platen 64 carrying the severing elements will first be described. The upper platen 64 carries with it a removable upper choerd 230 shown in FIG. 7. This upper choerd 230 comprises a rigid substrate, for example, plywood and a hard board 234 having thereon severing elements defining one pattern to be defined in the material 126. Several pattern elements are shown in FIG. 8. For example, FIG. 8 illustrates one hard board 236 having an array of severing elements defining a sleeve element with a second board 238 defining for example, a collar.

In accordance with the present invention, the severing elements comprise a resistance wire, for example, a nichrome wire 240 bent in a predetermined fashion. As shown in FIGS. 7, 8 and 9, a series of stand-off insulators 242 are arrayed on the inside periphery of the wire 240. Each of the stand-off insulators has a hole 244. The resistance wire is fabricated to have predetermined lengths L shown in FIG. 7. The wire is prebent inward to engage into the hole 244 and then locked in position with a downward turn 240′, shown in FIG. 9. At this point, a 180° turn of the wire occurs and it then reverses direction passing out through hole 242, making two right angle turns and defining a second predetermined length L′, shown in FIG. 7.

A small gap exists between the bent portions of the wire 240 as it enters, passes through and bends at point 240 relative to the stand-off insulators 242. These bent portions define expansion joints for the resistance wire 240. Thus, during heating, tendency of the wire to expand and distort, thereby distorting the pattern to be severed is avoided since the predetermined length L and L′ are maintained. Expansion is compensated by the bent portion and gap existing therein such that no effective lengthening of the predetermined length L occurs.

The stand-off insulators 242 are arrayed as shown in FIG. 8 on the inside portion of the wire 240 and mounted to the hard board sections 234. While closed loops are shown pickup points are provided to allow for leads for a supply of power to the wires 240. It will, therefore, be appreciated that the wire 240 having fabricated lengths L, and expansion joints is bent into a predetermined shape defining the pattern to be severed in the material 126. The wire also may be prefabricated having the bent portions inserted into the stand-off insulators 242 prior to mounting on the board 234. The wire 240 is then angled at selective points, for example, 250, 252, 254, et seq. to define the pattern to be severed. Alternatively, the stand-off insulators 242 are first positioned to receive the bent portions 240 and are mounted on the hard board 234 to define the basic pattern. Bent portions of the wire are then inserted and the severing wire defining the exact pattern. Free end portions are coupled to the power supply and ground (not shown), coupled into the control circuit (not shown) and the entire top choerd 232 is then ready for use. As shown in FIGS. 8 and 9, rubber foam block 260 are placed at selective points in the pattern to first contact the fabric 126. Thus, the fabric is held in position by the foam 260 and by further downward movement of the top platen 64 the material 126 is placed in contact with the severing wires 240. FIG. 9 illustrates a groove 262 which is preburned into foam rubber 96 on the lower choerd. Thus, as a first step in the severing process, the top platen 64 carrying the upper choerd 232 is lowered so that the wires 240 contact the foam rubber 96 to define the pattern to be cut in that foam section. This preburned groove allows for slight depression of the fabric 126 and subsequent severing steps occur so that no stretching of the fabric occurs in the area to be severed. Thus, as shown in FIG. 16A and 16B in the top platen 64 is lowered so that the wires 240 contact either the single layer (16A) or multiple layers (16B) severing of the material occurs.

The upper choerd 232 is fixed to the top platen 64 by means of Velcro strips or the like. Removal of the top choerd 232 occurs by use of cylinders 270, 272 shown in FIGS. 16A to eject the top choerd 232 from the top platen 64. Consequently, the top choerd can be removed so that other choerds containing different patterns are mounted on the top choerd can be affixed to the top platen 64. Consequently, by utilizing different patterns mounted on various top choerds, a multitude of patterns may be severed from the material.

In operation, a lower choerd is placed on the substrate 18 utilizing the transverse pulley system 100, shown in FIG. 2. It will be understood that this lower choerd 94, 96 may have flat material thereon for severing. Reciprocation of the top platen 64 carrying the upper choerd 232 then occurs in a manner as described herein effectuates severing of material already placed on the lower choerd.

If, however, material is to be removed from a roll, then, with a lower choerd 94, 96 in position, removal of material from roll 120 utilizing the registration technique shown in FIGS. 10–13 occurs. Spreader roll 60 then in a manner shown in FIGS. 14–16 spreads either a single or two plies of material onto the choerd. Spread roll 60 then moves to the left outside the severing area and reciprocates under the substrate 18 for movement of the chains 32, 34. When the spreader roll 60 is outside the severing area, the top platen 64 is then lowered to sever material which is deposited on the lower choerd 94, 96. The top platen 64 then moves vertically and spreading of additional layers on top of those already severed then occurs. That is, spreader roll 60 having completed its travel is in a position shown in FIG. 10 ready to receive material 126. The spreader roll 60 traverses the bottom choerd 94, 96 a second time depositing either a single ply or two plies on top of those plies already cut. Because spreading occurs in the absence of any tension, there is no relative movement between material already severed and material which is being spread. When the spread roller has reached a position shown in FIG. 15, top platen 64 then begins reciprocation in the downward direction shown in FIG. 16 to sever plies just spread. The entire array of wires severs simultaneously; that is multiple patterns are formed at the same time.

When a sufficient height of material severed has been built up by multiple iterations of the system achieved, the lower choerd 94, 96 is removed from the substrate 18 by action of the belt 100. It will be appreciated that the materials severed are thus stacked for subsequent removal and processing. No intermixing or shuffling of components has resulted. Accordingly, a significant material saving in downstream processing occurs. A typical cycle time is in the range of 10–25 seconds for spreading and cutting.

When different pieces are to be severed, that is different patterns to be utilized for downstream processing, then the upper choerd 232 is ejected and a new upper choerd having a different pattern array are placed on the top paten 64. Operation continues in a manner described herein with spreading and severing now however, of different patterns.

While this invention has been described relative to its preferred embodiment, it is apparent that a number of modifications may be practiced without departing from the essential scope of the invention. For example, while the top choerd 232 has been shown as having severing wire bent to define the pattern and mounted via standoffs 242, this arrangement can be replaced with a matrix of bent cutting elements. By selective actuation, for example using a bit and line actuation system, under computer control, any pattern can be defined in the matrix.

This invention has been described in the context of input roller 120 being free wheeling. However, for big rolls of material, a significant amount of inertia can take place as that roller rotates in response to action of driven roller 130. Thus, in some circumstances the roll 120 may be independently driven utilizing a step drive system to selectively drive and brake the roll 120 and therefore deplete any inertia which would tend to be generated.

While not illustrated, it is also apparent that a technique of marking pieces severed can be employed in the context of this invention. For example, as shown in FIG. 8, sufficient area exists on the hard board 232 to provide an inked source which would place, for example, ink on the material 126 when the pattern has been defined. Thus, an inker, not shown, can be placed at a portion within each pattern and when contact is made with the material 126 an identifying label can be placed on the severed pattern.

Also, while not illustrated in the context of this invention, it is apparent that during the technique of moving material from roll 126, for example through guides 140 and 142, inspection of that material for purposes of defect detection can take place. A scanner, suitably placed, across the width of the material 126 can therefore determine the presence of defects in the material as it passes through the system prior to spreading. By actuation of the cutter 150, defective areas can be removed and the operation recycled.

The top platen is movable utilizing the jack screw system to move lead screw 68. The system can be positively driven as a function of thread 92 advancement. Alternatively, proximity switches may be placed in the top platen to determine the height of the stacked material so that vertical travel may be controlled and thereby control the penetration of the wires 240 as a function of stack height. Consequently, the wires will not penetrate through layers already severed. Control of travel of the spreader roller 60 and severing element 62 is a function of movement of the chains 32 and 34. Such can be determined by establishing zero reference position, trip switches or the like. Alternatively, proximity sensors can be placed along the length of the table to determine the position of the spreader roll and stop it at predetermined positions for proper sequencing vis-a-vis severing the end off of a roll 120 for single ply cutting or for actuation of the system to spread multiple plies. Proximity sensors are employed and standard machine control processors are utilized to sequence the steps illustrated in the figures.

It will also be appreciated that such a system controller would employ temperature sensors such as thermocouples in each electrical circuit to prevent overheating. A system controller would have stored therein parameters such as heat and dwell times for various fabrics so that controlled severing occurs. That is, such a system controller would have preprogrammed therein a matrix of heat and dwell times necessary to sever various input materials. The system controller would then control the vertical movement of the top platen 64 as well as the temperature cycling of the resistance wire 240 so that optimum severing occurs. In such a system the travel distance to the top platen and spreader roller would also be under control of the system controller.

Finally, while not shown, edge guides may be employed to center the material for alignment once it has been spread. That is, the bottom choerd 94–96 and the substrate 18 may have througholes and fingers, the substrate 18 may have througholes and fingers, pneumatically actuated and protruding therethrough. The fingers would selectively project upward to contact the material 126 for centering the material without stress and without creating any wrinkles.

It is apparent that other modifications of this invention may be practiced without departing from its essential scope.

I claim:

1. A system for spreading and severing material comprising;

a severing table;

a source of material disposed remote from said severing table;

means for spreading said material without tension comprising a spreader engaging said material at one end of said severing table, means to move said spreader across said severing table whereby at least one layer of said material is placed on said severing table;

an array of electrical resistance elements movable over said layer of material for contact therewith to simultaneously sever said material into multiple patterns; and first severing means for severing said material at a position adjacent to one end of said severing table and second severing means movable with said spreader for severing said material when said spreader has traversed said severing table a predetermined distance, and means for determining the distance said spreader traverses said severing table.

2. The system of claim 1 wherein said material comprises a roll of flexible fabric, said roll mounted above said severing table at one end thereof.

3. The system of claim 1 wherein said spreader comprises a roller positioned above said severing table, and said means to move comprises an electric motor, a pair of drive chains placed on respective sides of said severing table and a frame mounting said roller to said chains.

4. The system of claim 3 further comprising means to determine the position of said spreader as it traverses said severing table.

5. The system of claim 4 wherein said means to determine the position of said spreader comprises a shaft encoder measuring rotation of said electric motor.

6. The system of claim 1 further comprising a clamp positioned at one end of said cutting table, said clamp engaging an end of said material delivered from said source of material and holding it, whereby when said spreader engages said, the material loops over said spreader and moves, so that said material is fed from said source and spread over said severing table without tension.

7. The system of claim 6 further comprising a sensor to determine when said end of said material is clamped, control means response to said sensor to commence movement of said spreader across said severing table, means to determine the extent of movement of said spreader across said table and, severing means for severing said looped material when said spreader has traversed a predetermined distance across said severing table.

8. The system of claim 7 further comprising second severing means carried by said spreader for severing said material at said loop when said spreader has traversed a second predetermined distance across said severing table whereby two plies of material are spread across said severing table without tension.

9. The system of claim 1 wherein said array of resistance elements comprises a first resistance wire bent into increments of predetermined length, first standoff insulators mounted on a substrate said first wire inserted at its bent portions into said stand-off insulators and held thereby, said increments defining the outline of one pattern to be cut, said first resistance wire having folds at predetermined locations providing thermal expansion joints; and at least a second resistance wire bent into increments of predetermined length, second stand-off insulators mounted on said substrate and said second wire inserted at its bent portions into said second stand-off insulators, said second increments defining the outline of a second pattern to be cut, said second resistance wire having folds at predetermined locations providing thermal expansion joints.

10. The system of claim 9 further comprising a substrate mounting said resistance wires and said insulators.

11. The system of claim 10 further comprising means to raise and lower said substrate relative to said severing table and, means to sense the position of said resistance wires relative to said material on said severing table.

12. The system of claim 11 wherein said means to raise and lower said substrate comprises a series of jack screws for raising and lowering said substrate in parallel to said severing table.

13. The system of claim 1 further comprising a removable choerd positioned on said severing table, said choerd comprising a rigid backing, a cushion layer placed on said rigid backing and at least a layer of material severed by said array of electrical resistance elements.

14. The system of claim 13 wherein said choerd further comprising additional layers of material severed by said electrical resistance elements.

15. The system of claim 13 further comprising means to move said choerd relative to severing table wherein completed cut material are removed from said severing table while positioned on said rigid backing.

16. The system of claim 15 wherein said means to move said choerd comprises a series of conveyor belts mounted in said severing table and movable in a direction perpendicular to the direction of movement of said means for spreading.

17. The system of claim 1 further comprising a movable platen carrying a substrate said array of electrical resistance elements mounted on said substrate and means to remove said substrate from said platen.

18. The system of claim 17 further comprising control means for controlling movement of said spreader, said control means varying the acceleration and decelleration of said spreader at the start and end of spreader movement.

19. The system of claim 18 wherein said control means further comprises sensor means to determine movement of said array relative to said severing table, said control means responsive to said sensor means to regulate the movement of said platen.

* * * * *